US009956133B1

(12) United States Patent
Afshar

(10) Patent No.: US 9,956,133 B1
(45) Date of Patent: May 1, 2018

(54) VIBRATION DEVICE AND USE THEREOF

(71) Applicant: Shahriar S. Afshar, Encino, CA (US)

(72) Inventor: Shahriar S. Afshar, Encino, CA (US)

( * ) Notice: Subject to any disclaimer, the term of this patent is extended or adjusted under 35 U.S.C. 154(b) by 143 days.

(21) Appl. No.: 14/199,053

(22) Filed: Mar. 6, 2014

Related U.S. Application Data

(63) Continuation of application No. 12/902,865, filed on Oct. 12, 2010, now abandoned.

(60) Provisional application No. 61/278,828, filed on Oct. 13, 2009.

(51) Int. Cl.
*A61H 23/00* (2006.01)

(52) U.S. Cl.
CPC ... *A61H 23/004* (2013.01); *A61H 2201/0153* (2013.01); *A61H 2205/083* (2013.01)

(58) Field of Classification Search
CPC ..... A61H 1/008; A61H 23/004; A61H 23/02; A61H 23/0254; A61H 23/0263
See application file for complete search history.

(56) References Cited

U.S. PATENT DOCUMENTS 2,661,736 A 12/1953 Schwartz
2,683,451 A 7/1954 O'Connor
3,096,758 A * 7/1963 Savage ..... A61H 23/0218 164/DIG. 5
3,169,521 A 2/1965 McCaw
3,585,990 A 6/1971 Blachly et al.
4,149,530 A 4/1979 Gow
4,684,124 A 8/1987 Escher
5,704,902 A 1/1998 Vandenbelt et al.
5,823,913 A 10/1998 Aruin et al.
6,511,446 B1 * 1/2003 Wu ..... A61F 7/02 601/15
7,318,811 B1 * 1/2008 Corbishley ..... A61H 19/50 601/70
7,468,046 B2 * 12/2008 Takashima ..... A61H 9/005 601/46
2003/0120185 A1 6/2003 Dirks et al.
2003/0158504 A1 * 8/2003 Hiyamizu ..... A61H 1/00 601/99
2005/0020947 A1 1/2005 Dehli
2005/0277856 A1 12/2005 Munro
2006/0094992 A1 * 5/2006 Imboden ..... A61H 19/00 601/70

(Continued)

*Primary Examiner* — Justine Yu
*Assistant Examiner* — Kathrynn Lyddane
(74) *Attorney, Agent, or Firm* — Fish & Richardson P.C.

(57) ABSTRACT

Described herein is a device for tightening the abdominal muscles (e.g., rectus abdominus) at any time, including prior to eating. In more detail, for a duration prior to eating, the vibration device may be held forcefully against the abdomen to impart vibrations to the abdominal muscles. While the vibrations are being imparted, the abdominal muscles may also be contracted. The vibration device may include a base having a first surface and second surface, with the second surface facing the abdominal muscles, and a shaft movable relative to the base along an axis, with the shaft extending outwardly from the first surface. A motor may be configured to produce vibrations substantially along to the axis. The vibrations may be of sufficient magnitude to cause corresponding vibrations in the base and thus the abdominal muscles. A mechanism may be used to control the motor.

16 Claims, 7 Drawing Sheets

(56) References Cited

U.S. PATENT DOCUMENTS

| | | | | |
|---|---|---|---|---|
| 2007/0179414 | A1* | 8/2007 | Imboden ..... | A61H 19/00<br>601/72 |
| 2007/0203436 | A1 | 8/2007 | Kamimura et al. | |
| 2009/0112134 | A1 | 4/2009 | Avni | |
| 2009/0182249 | A1 | 7/2009 | Sakai et al. | |
| 2009/0221944 | A1 | 9/2009 | Hobson et al. | |

* cited by examiner

VIBRATION DEVICE AND USE THEREOF

CROSS-REFERENCE TO RELATED APPLICATION

This patent application is a continuation of U.S. patent application Ser. No. 12/902,865, filed on Oct. 12, 2010. The contents of U.S. patent application Ser. No. 12/902,865 are hereby incorporated by reference into this patent application as if set forth herein in full. This patent application claims the benefit of priority to U.S. Provisional Application No. 61/278,828, filed on Oct. 13, 2009. The contents of U.S. Provisional Application No. 61/278,828 are hereby incorporated by reference into this patent application as if set forth herein in full.

TECHNICAL FIELD

This patent application relates generally to a vibration device that may be used to tighten the abdominal muscles of a person.

BACKGROUND

Weight loss involves a balance between caloric intake and expenditure. To lose weight, the amount of calories expended must exceed the amount of calories taken-in. The amount of calories taken-in typically corresponds to the volume of food that is eaten. One way to reduce caloric intake, therefore, is to eat less. Hunger, however, often limits a person's ability to reduce the amount of food that they eat.

SUMMARY

This patent application describes a vibration device that may be used to tighten the abdominal muscles at any time, including prior to eating. Tightening the abdominal muscles prior to eating restricts the amount that the stomach can expand, and thus that the stomach can hold. As the stomach expands, pressure-sensitive receptors in the stomach contact the tightened abdominal muscles, causing satiation signals to be sent to the brain. As a result, the person feels fuller sooner and eats less. Over time, this can lead to weight loss.

Described herein is a method in which, for a duration prior to eating, a vibration device is held forcefully against an abdomen to impart vibrations to abdominal muscles. The method may include any one or more of the features described herein either alone or in combination, examples of which are as follows.

A frequency at which the vibration device vibrates may be changed during the duration. Vibration of the vibration device may be along an axis that intersects the abdominal muscles. The axis may be substantially orthogonal to the abdominal muscles.

The method may include contracting the abdominal muscles while the vibrations are imparted, and exhaling while contracting the abdominal muscles.

Vibrations produced by the vibration device are not imparted directly to a back.

The duration may occur within a ten minutes of eating. The duration may occur immediately prior to eating. The duration may be at least one minute.

The vibration device may include a base having a first surface and second surface, with the second surface facing the abdominal muscles, and a shaft movable relative to the base along an axis, with the shaft extending outwardly from at least the first surface. A motor is configured to produce the vibrations substantially along the axis. The vibrations are of sufficient magnitude to cause corresponding vibrations in the base. A mechanism is used to control the motor.

Also described herein is a device that includes a base having a first surface and second surface, and a shaft movable relative to the base along an axis, with the shaft extending outwardly from at least the first surface. A motor is configured to produce vibrations substantially along the axis. The vibrations are of sufficient magnitude to cause corresponding vibrations in the base. A mechanism is used to control the motor. The device may include any one or more of the features described herein either alone or in combination, examples of which are as follows.

The motor may comprise a switch. The mechanism to control the motor may comprise a spring in the shaft that is configured to compress in response to force directed substantially along the axis towards the base. The switch is proximate to the spring so that an element contacts the switch when the spring is compressed to thereby activate the motor.

The device may comprise a handle at an end of the shaft that is farthest from the first surface. The handle may be configured to lessen effects of vibration on hands holding the handle. The element may be connected to the handle.

The motor may comprise an off-center mass electric motor. The mechanism to control the motor may comprise a dynamic force selector. The dynamic force selector may be configurable to apply a force to a switch that activates the motor.

The shaft may intersect the base and extend outwardly also from the second surface. A nub may be included, which is shorter than the shaft A controller may provide a signal to the motor. The signal may correspond to a vibration that the motor is to produce. The controller may comprise a programmable processing device. The device may comprise a user interface to provide an input that corresponds to the vibration. The second surface may have a curvature that extends away from a part of the shaft that extends outwardly from the first surface. The device may comprise a heating element on the second surface.

At least part of any of the foregoing may be implemented as a device, method, or system that may include circuitry and/or one or more processing devices and memory to store executable instructions to implement the stated functions.

At least part of any of the foregoing may be implemented as a computer program product comprised of instructions that are stored on one or more non-transitory machine-readable storage media, and that are executable on one or more processing devices.

The details of one or more implementations are set forth in the accompanying drawings and the description below. Other features, objects, and advantages will be apparent from the description and drawings, and from the claims.

DESCRIPTION OF THE DRAWINGS

Like reference numerals show like elements in the figures.

DETAILED DESCRIPTION

Figure 1:
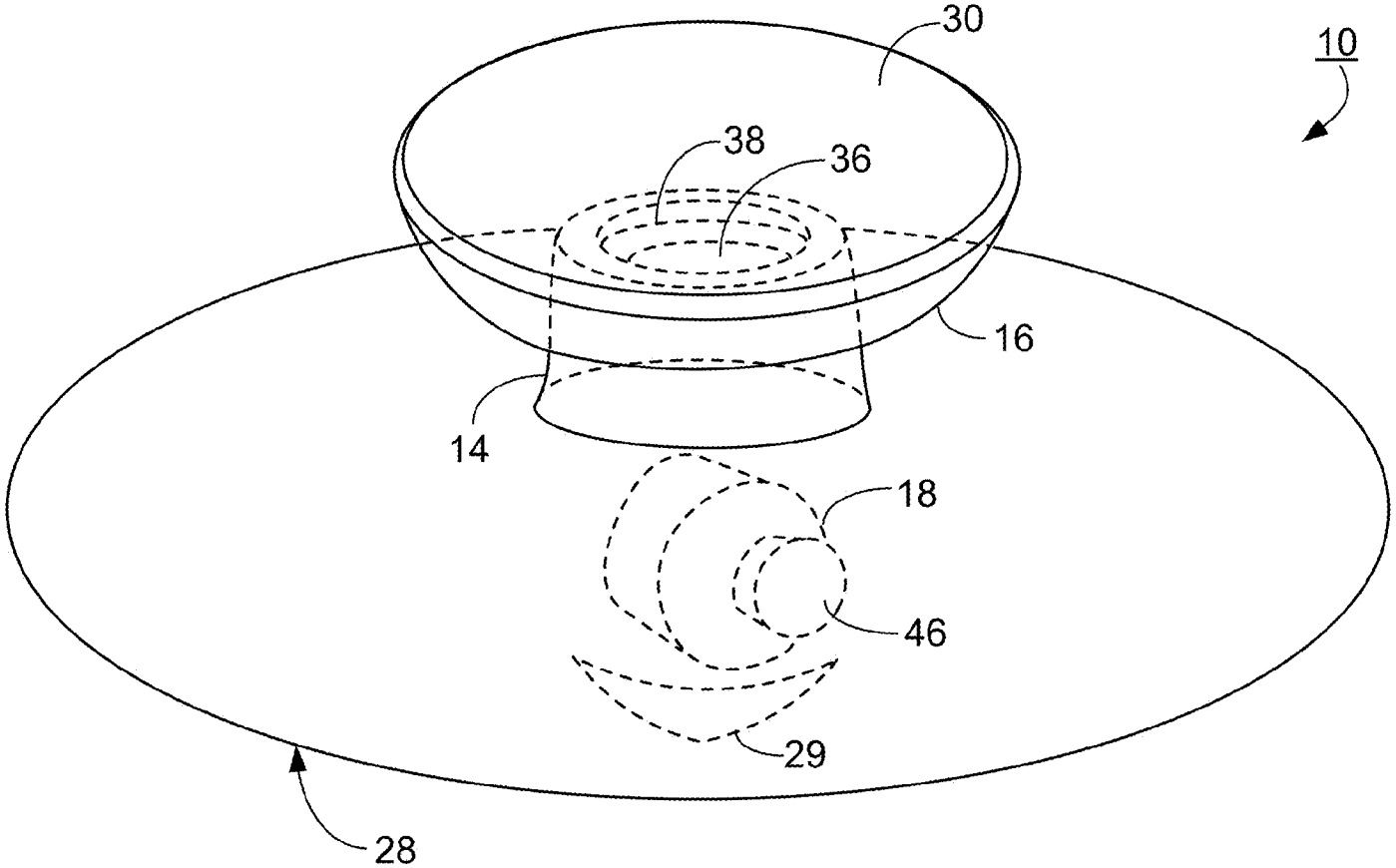
FIG. 1 is a perspective view of parts of a device for generating vibrations, which shows inner structures of the device using dashed lines.

Described herein is a device for tightening the abdominal muscles (e.g., rectus abdominus) at any time, including prior to eating. In more detail, for a duration prior to eating, the vibration device may be held forcefully against the abdomen to impart vibrations to the abdominal muscles. While the vibrations are being imparted, the abdominal muscles may also be contracted. The vibration device may include a base having a first surface and second surface, with the second surface facing the abdominal muscles, and a shaft movable relative to the base along an axis, with the shaft extending outwardly from the first surface. A motor may be configured to produce vibrations substantially along to the axis. The vibrations may be of sufficient magnitude to cause corresponding vibrations in the base and thus the abdominal muscles. A mechanism may be used to control the motor.

FIGS. 1 to 4 show an implementation of the vibration device described above. Device 10 includes base 12, shaft 14, handle 16, and motor 18. Shaft 14 is substantially orthogonal to base 12, and intersects base 12 at point 20. The part 22 of the shaft that extends outwardly from the surface 24 of base 12 extends towards handle 16. The part 26 that extends outwardly from surface 28 of base 12 is shorter than part 22. Part 22 terminates in nub 29. Nub 29 may be rounded or terminate in a soft point, as shown in the figures. Some implementations may not include part 26 or nub 29.

Handle 16 may be shell-shaped, as shown in the figures, or it may have any other shape that can be gripped and held while vibrations are propagated along shaft 14. In the shell-shaped implementation shown in the figures, handle 16 has a rounded top 30, and a substantially convex underside 32 that connects directly to shaft 14. In other implementations, handle may include hand-compatible grips that connect to, or are on, shaft 14. Handle 16 may be fabricated from a hard material, such as plastic or metal, or from a softer material that may dampen vibrations from shaft 14. The softer material may include rubber or cloth, for example. Alternatively, handle 16 may include an inner core of hard material and one or more outer layers softer material. For example, a rubber collar 34, such as that shown in FIG. 2, may surround all or part of handle 16.

Figure 2:
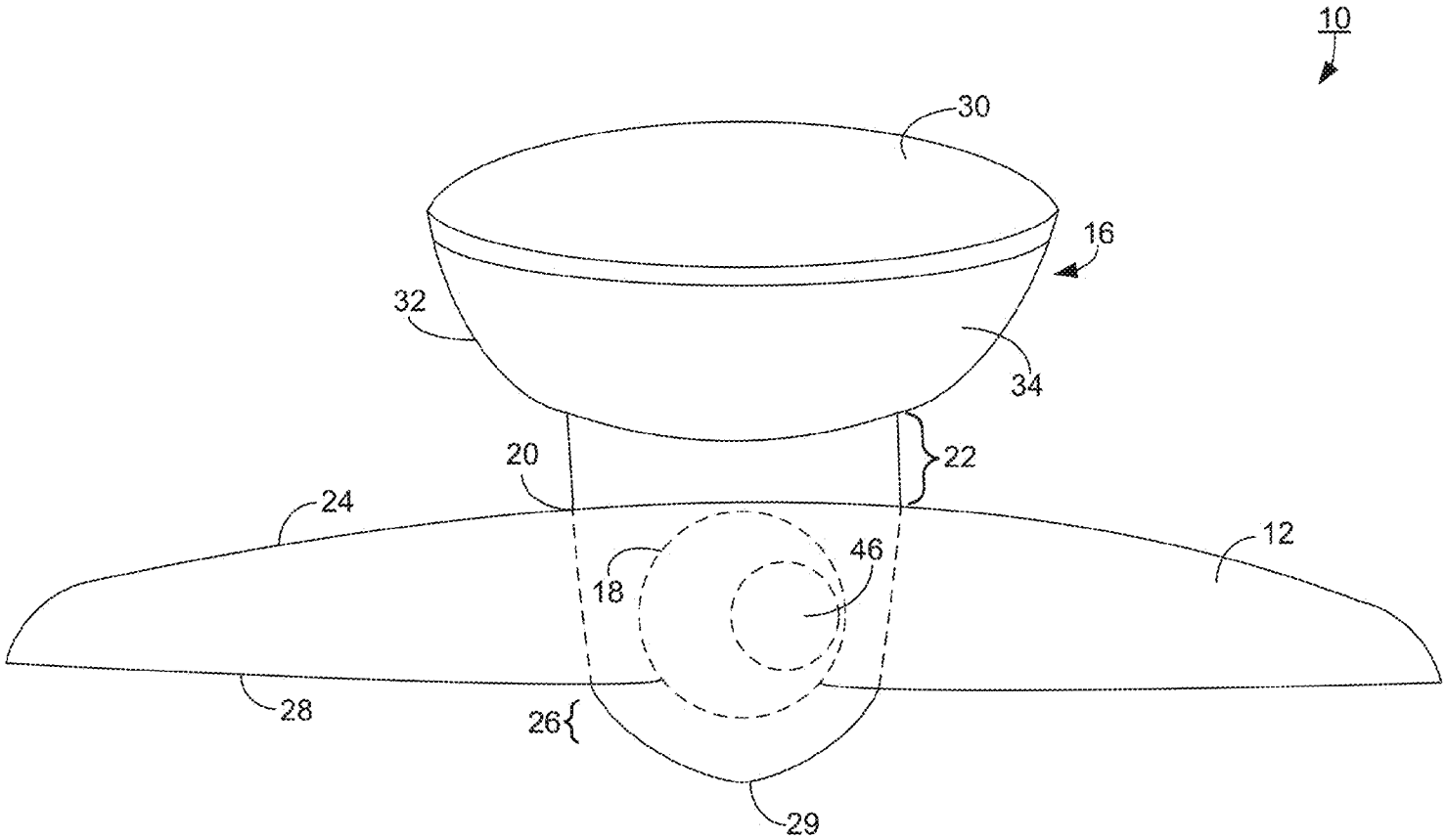
FIG. 2 is side view of the device of FIG. 1, which shows inner structures of the device using dashed lines.
Figure 3:
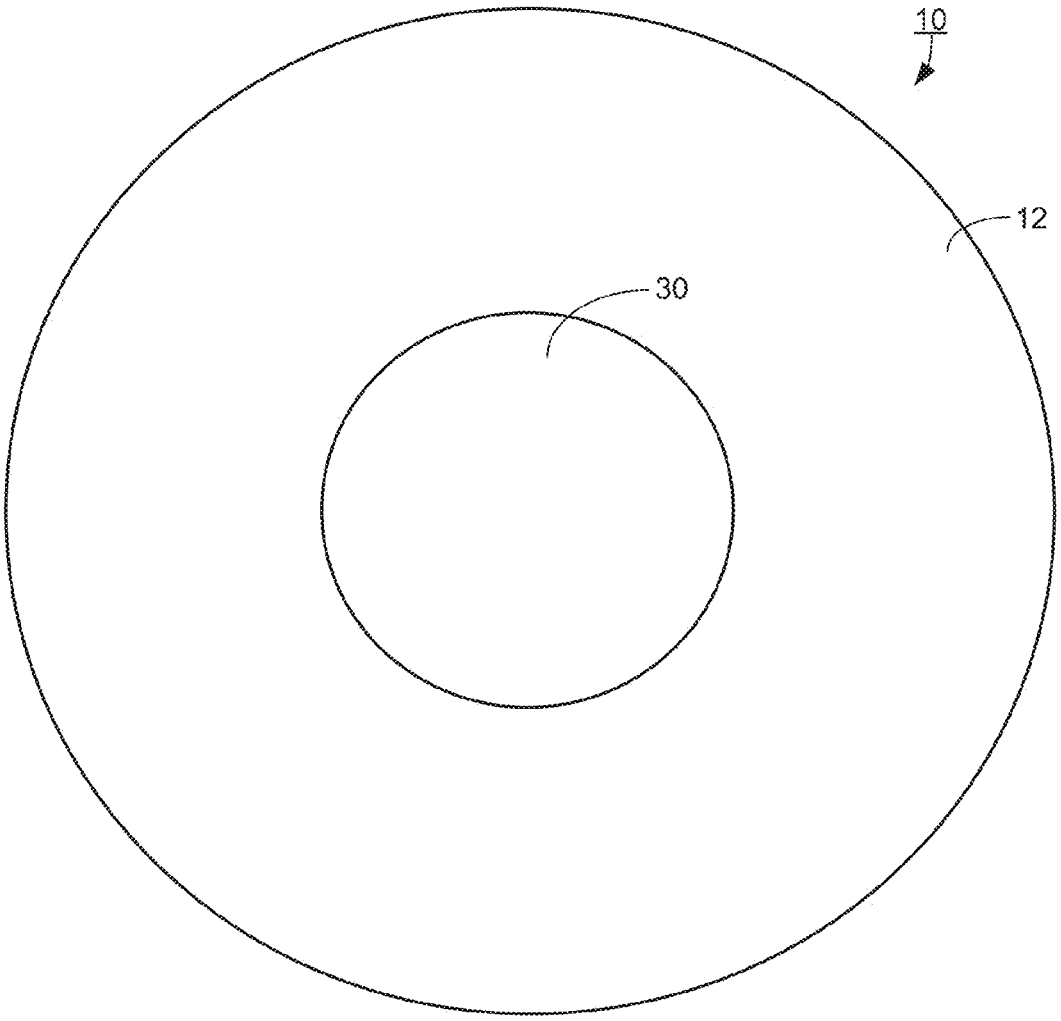
FIG. 3 is a top view of the device of FIG. 1.

Base 12 may be circular, as shown in FIG. 3, or it may have any other shape (e.g., oval, square, rectangular, etc.). In this regard, base 12 may be made from a hard material, such as plastic, or a softer material, such as rubber. As was the case for handle 16, base 12 may include a hard inner core and a softer outer covering (e.g., a rubber collar). The cross-section of base 12 may be convex, as shown in FIG. 2. That is, surface 24 of base 12 may slope downwardly towards surface 28, as shown in FIG. 2.

Surface 28 may be substantially flat or have a curvature. The size and curvature (if any) of surface 28 may correspond substantially to the size and curvature of an abdomen that is deemed average for the population. In this regard, the size and curvature of surface 28 may be adjustable to accommodate differently-sized abdomen sizes. To this end, base 12 may include attachments (not shown) that affix to the base to change (e.g., increase) the size of the base or to change the curvature of the base to accommodate those with larger abdomens. The attachments may clip onto the base or be fixed using screws or other fasteners.

Figure 4:
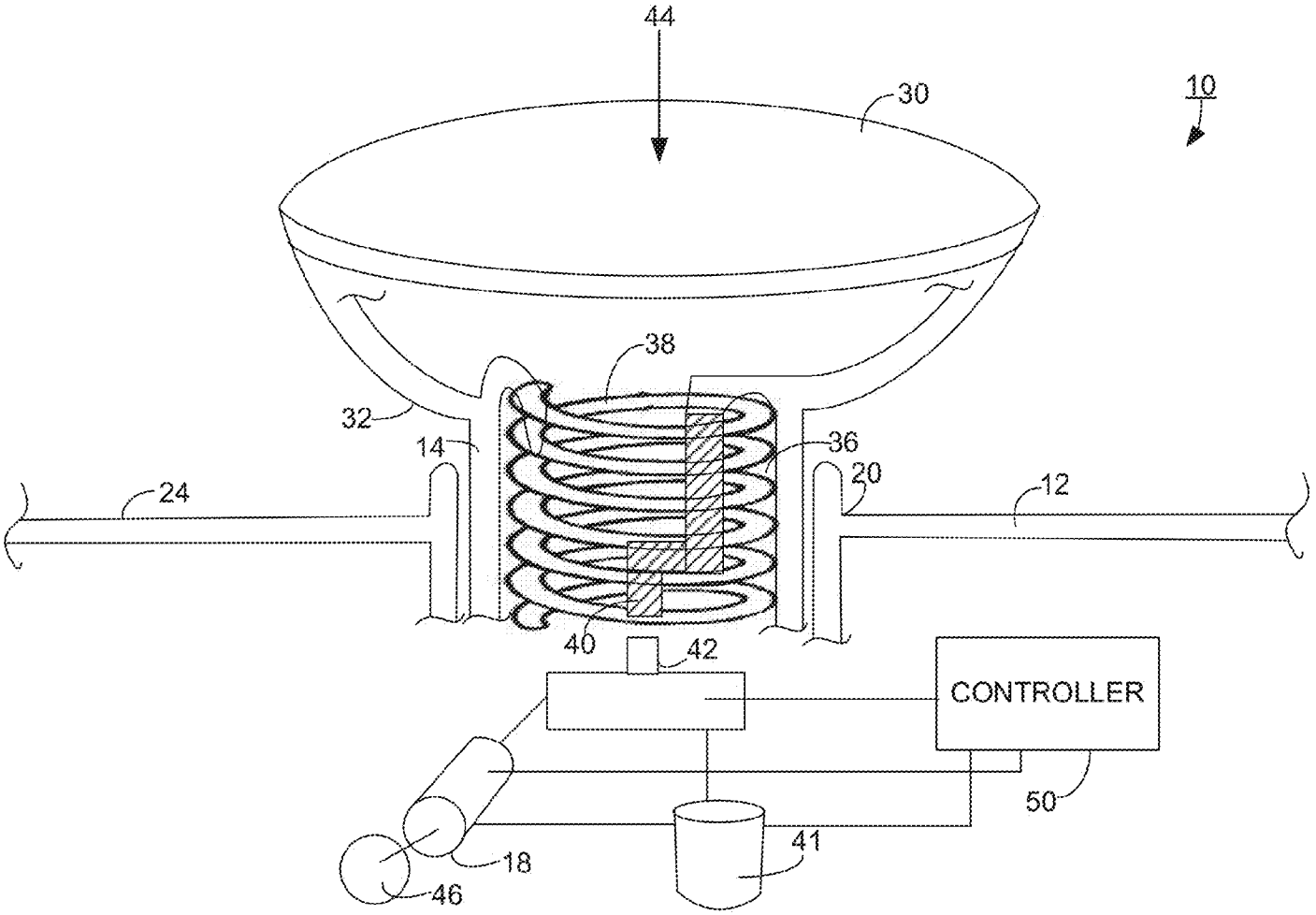
FIG. 4 shows a cut-away side view of the device of FIG. 1, which shows the motor and electronics brought out in perspective view.

As shown in FIGS. 1 and 4, shaft 14 moves within a throughbore 36. Throughbore 36 holds a spring 38 that is movable within throughbore 36 in response to pressure applied, e.g., via handle 16. Although only one spring is shown, the functions of spring 38 described herein may be implemented by a combination of springs and/or other mechanical, electrical and/or electro-mechanical devices. Handle 16 includes an element 40 (see FIG. 4) that extends into, and is movable within, throughbore 36. The portions of the handle, element and shaft within the throughbore may be limited in terms of how far outside the throughbore they can move, thereby preventing them from being pulled out of the throughbore.

FIG. 4 shows a cut-away side view of the device of FIG. 1, which shows the motor and electronics brought out in perspective view. The motor, switch, controller and associated features may be located entirely or partially within base 12 (e.g., between surfaces 24 and 28). Proportions of FIG. 4 are not necessarily to scale and the various components are drawn to illustrate the relationships among the components.

In its relaxed (uncompressed) state, spring 38 is interposed between, and proximate to (e.g., touching), an end of handle 16 and/or a switch 42 that controls motor 18. Spring 38 may be compressed by holding base 12 stationary and applying a downward pressure to spring 38 via the handle. As shown in FIG. 4, the pressure may be applied along vector 44. Compression of spring 38 applies pressure to base 12 and brings element 40 into contact with switch 42. Closing switch 42 in this manner activates motor 18. In this implementation, pressure must continue to be applied to switch 42 in order to keep motor 18 active. If pressure on the switch is reduced enough, switch 42 opens, thereby deactivating motor 18. As shown in FIG. 4, handle 16 may come into contact with the base when spring is compressed and element 40 activates switch 42. In alternative implementations, the portion of the base that extends above surface 24 may be omitted, leaving only a shaft within base 12.

Motor 18 may be an off-center mass electric motor. Generally speaking, an off-center mass electric motor includes a motor that drives an off-center mass 46 to produce vibrations. Motor 18 is physically connected to base 12 and/or shaft 14, and is powerful enough to cause shaft 14 and base 12 to vibrate. The vibrations are substantially parallel to the axis of the shaft. In other words, the vibrations are substantially orthogonal(90°) to base 12, e.g., along vector 44. In other implementations, the shaft and spring need not be orthogonal to the base. Rather, they may be angled relative to the base, resulting in vibrations that are along a vector that correspond to that angle.

Figure 5:
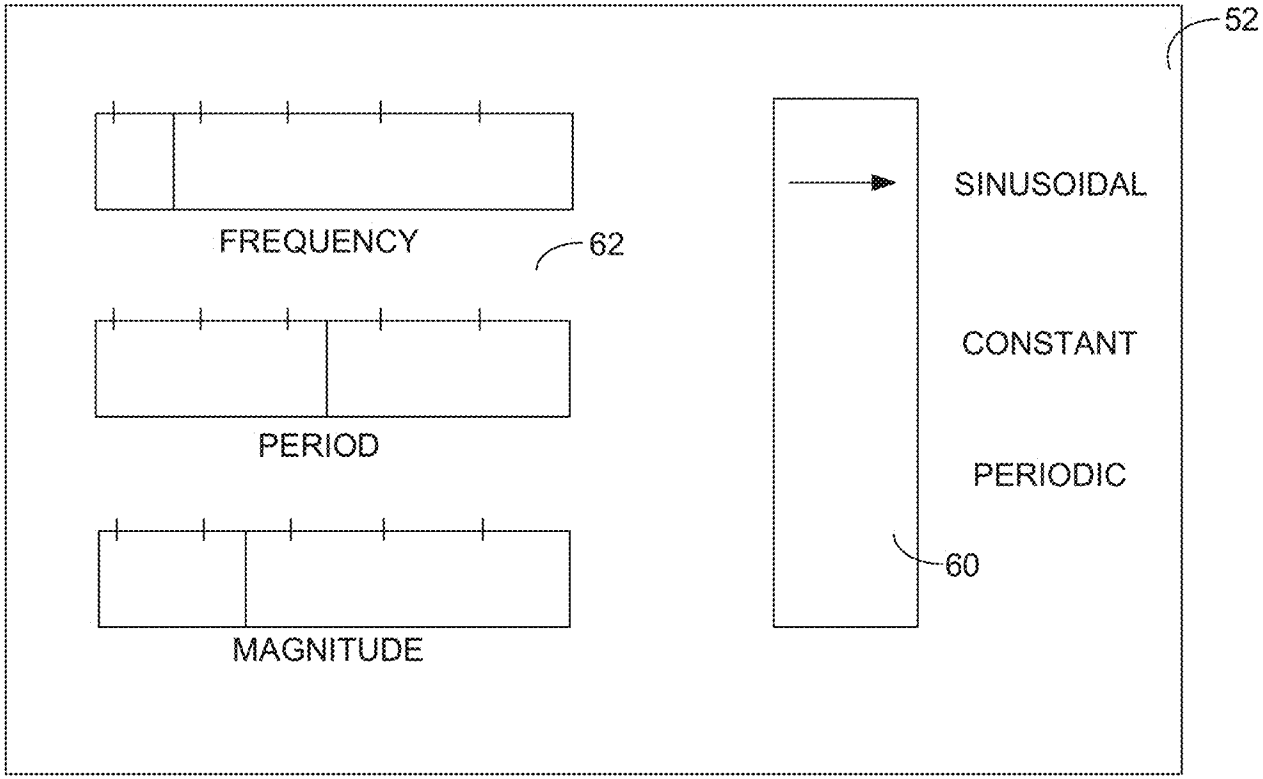
FIG. 5 is a user interface that may be used with the device of FIG. 1.

A controller 50 may be used to control operation of motor 18. Controller 50 may be a microprocessor or other processing device that may be mounted on a printed circuit board (PCB) or other substrate contained in the base or elsewhere. In operation, controller 50 detects closure of switch 42 and, in response, sends one or more control signals to motor 18 to control its operation. Controller may also control opening and closing of switch 42 in some implementations. Controller 50 may be programmed with firmware to operate motor 18 the same way each time it is activated, or controller 50 may be programmed to operate controller in response user or other external input(s). In this regard, device 10 may include a user interface, such as that shown in FIG. 5. User interface 52 allows a user to select from among available pre-programmed vibration modes 60 and/or to customize one or more vibration mode/sequences via adjustors 62. User interface 52 may include mechanical switches or it may be a touch-sensitive interface. Examples of different vibration modes and customized vibration modes/sequences are described below. These are intended as examples only, and are not intended to limit the types of vibrations that can be produced or programmed.

In an example, controller 50 may be programmed to control motor 18 to produce substantially constant vibrations for a predefined or set period of time. A similar effect may be achieved by omitting controller 50 from device 10 and controlling motor 18 manually via the manual control mechanisms described herein (e.g., spring 38, element 40, and handle 16).

In an example, controller 50 may be programmed to control motor 18 to produce a sinusoidal vibration pattern. A sinusoidal vibration pattern may include a period of high-frequency vibrations, followed by a period of low-frequency vibrations, followed by a period of high frequency vibrations, and so on. Alternatively, a sinusoidal vibration pattern may include a period of low-frequency vibrations, followed by a period of high-frequency vibrations, followed by a period of how frequency vibrations, and so on. Controller 50 may be programmed to control the periods, frequencies, and magnitudes of the vibrations in accordance with user input or pre-programmed parameters.

In an example, controller 50 may be programmed to turn motor 18 on and off at varying intervals. For example, controller 50 may be programmed to operate motor 18 for a predefined interval, e.g., ten seconds, and, at the expiration each such interval, turn motor 18 off for, e.g., one or two seconds. As was the case above, controller 50 may be programmed to react to user input to control the periods, frequencies, and magnitudes of vibrations. Alternatively, the control information may be pre-programmed into controller 50.

In an example, device 10 may include a sensor 89 that senses the hardness of an abdomen against which the base is forced, and that calibrates periods, frequencies, and magnitudes of vibrations accordingly. For example, the sensor may inject current and measure body fat based on resistance. For harder abdomens, the periods, frequencies, and magnitudes of vibrations may be set lower than those for softer abdomens (or vice versa). In an example, it is assumed that larger periods, frequencies, and magnitudes of vibrations may be required to penetrate fat and other soft tissue surrounding abdominal muscles of those having softer abdomens in order for the vibrations to reach those abdominal muscles. Likewise, the sensor may react to a user's failure to contract his abdominal muscles, and thereby compensate for that with appropriate variations in the vibrations.

In an example, controller 50 may be programmed to keep track of time in order to ensure that a current use of device 10 is within a recommended time frame of, e.g., one or two minutes. Controller 50 may also be programmed to ensure that the frequency of vibration remains within a recommended range, e.g., 25 Hertz (Hz) to 80 Hz for a predefined body type, height, weight and sex. Controller 50 may be configured to request and accept inputs via its user interface 52 and to generate a vibration program customized for the user. For example, controller 50 may take into account inputs for a person's body type, height, weight and sex, among other things, and generate signals to control motor 18 so that motor 18 generates vibrations that are appropriate for that person.

In this regard, user interface 52 may be configured to accept commands via one or more wireless protocols, such as Bluetooth®. Through such a protocol, device 10 may be paired with a user's smartphone (not shown). An application ("app") on that smartphone may be used to program or otherwise control the operation of device 10. Device 10 may include other wired or wireless support that allows it to be programmed via a computer (not shown). In this regard, software in controller 50 may access a user's profile stored, e.g., on a computer and use that information to generate a vibration program for that person.

Referring to FIG. 2, surface 28 may include a heating element 90. The heating element may be an infrared heating element or any other type of heater, which may be covered by material to prevent burning of the base and of a person's skin that comes into contact with the base. The heating element may include spiral, radial, concentric circular, or continuous heating structure(s).

One or more battery(ies) 41 may be used to power device 10, e.g., to provide power to motor 18, controller 50, any heating element(s), and/or any other components that require power. Alternatively, power may be supplied to one or more such elements via a wall socket or a combination of a battery and wall socket. In this regard, any appropriate powering mechanism may be used in the operation of device 10.

Figure 7:
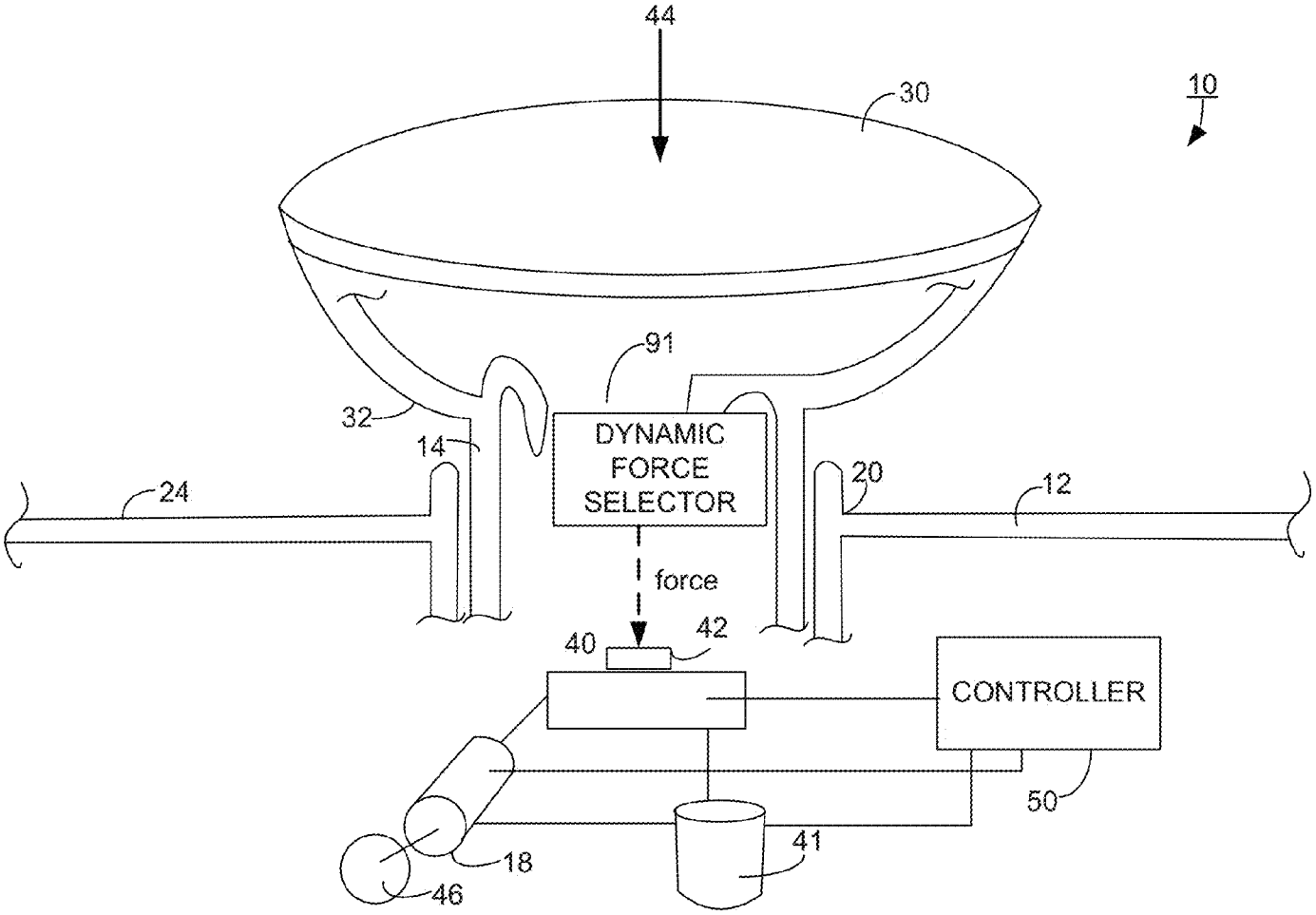
FIG. 7 shows a device for generating vibrations, which includes a dynamic force selector.

The device described herein is not limited to the construction shown in FIGS. 1 to 5. For example, switch 42 may be a pressure-sensitive button. Rather than using a spring 38 and element 40 to activate switch 42, device 10 may use a dynamic force selector 91 (FIG. 7) to control activation of switch 42. The dynamic force selector may be a device that responds to force applied by handle 16, and that transmits that force, either mechanically or electrically, to a switch to thereby control the operation of motor 18.

Figure 6:
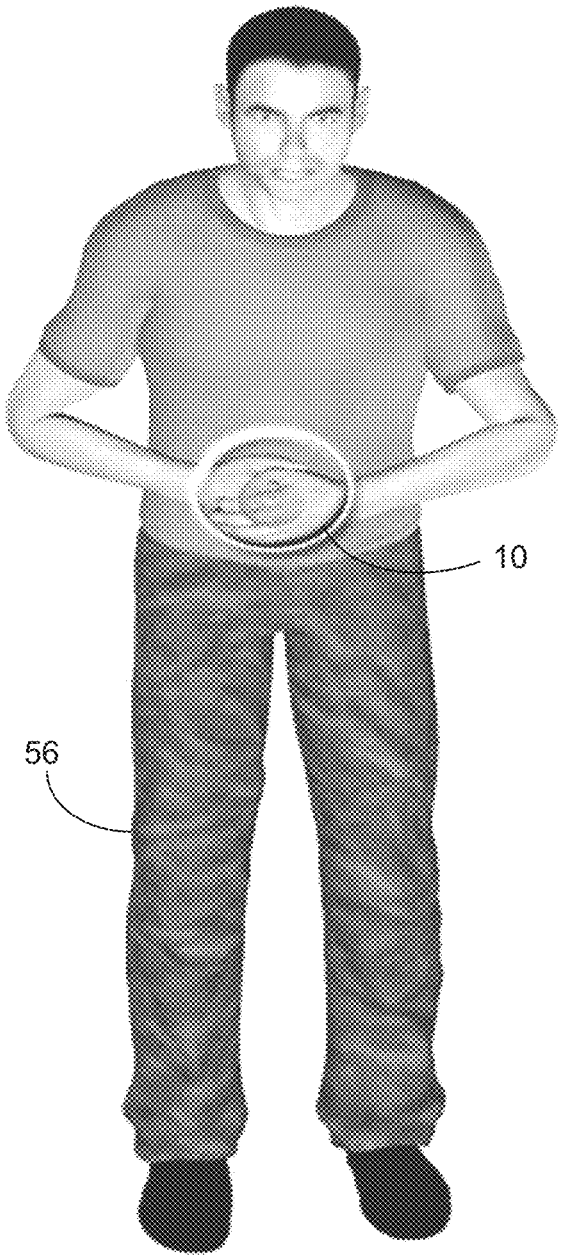
FIG. 6 shows a person using the device of FIG. 1.

FIG. 6 shows how device 10 operates. As shown in FIG. 6, person 56 places nub 29 at the location of his naval or any other location that the user believes is beneficial for his physiology. Assuming positioning at the naval, base 12 may have a diameter so that, from this position, vibrations produced by device 10 may target both lower and upper abdominal muscles. For example, base 12 may have a diameter that is roughly equivalent to a circle that encompasses a large human hand. However, any appropriate size may be used.

During basic operation, person 56 presses down on handle 16. This causes the shaft and spring 38 to move within throughbore, towards base 12. At some point, element 40 comes into contact with switch 42, which turns-on motor 18 and causes device 10 to vibrate in the manner described above. The vibrations are orthogonal to the plane of the person's abdominal muscles (and along the longitudinal axis of shaft 14). The resulting vibrations cause tightening and contraction of the person's abdominal muscles. If the user decreases pressure on handle 16, and thus on spring 38 and element 40, switch 42 may open, thereby turning-off motor 18 and stopping device vibration. To allow for continued operation, in this implementation the user applies pressure that is continuous and that is sufficient to keep switch closed during the operational period. In other implementations, e.g., for a non-pressure based switch, such continuous pressure may not be necessary.

To achieve enhanced benefit, person 56 may contract his abdominal muscles for most, if not all, of the period during which the vibrations occur. Additionally, the person may exhale while contracting the abdominal muscles in order to enhance the benefit.

As explained above, device 10 may have various operational options. For example, the user may select an operational mode that changes the vibrations in any of the ways described herein, e.g., to provide sinusoidal variations, periodic stoppage, constant vibrations, variations in periods, frequencies, and magnitudes of vibrations, and so on.

The operation of device 10 works the abdominal muscles so that they tighten over time, thereby enabling stronger contraction. In addition, use of device 10 promotes blood flow throughout the person's core, which can reduce fatigue and increase energy.

Device 10 may be used at any time, and for any duration, to exercise abdominal muscles. Device 10 may also be used to help promote weight loss. Specifically, device 10 may be used to exercise, and thereby tighten, the abdominal muscles prior to eating. The tightened abdominal muscles restrict the amount that the stomach can expand, and thus that the stomach can hold. As the stomach expands, pressure-sensitive receptors in the stomach contact the abdominal muscles, causing satiation signals to be sent to the brain. As a result, the person feels fuller sooner and eats less. Over time, this can lead to weight loss.

Thus, for a duration prior to eating, person 56 holds device 10 forcefully against his abdomen while contracting his abdominal muscles. The vibrations that are imparted by device 10 promote further contraction of the abdominal muscles. The duration may vary depending upon the person's body type, height, weight and sex, among other things. However, for an average person, a duration of one to two minutes will likely be sufficient to produce contraction of the abdominal muscles that can lead to weight loss over time. The periods, frequencies, and magnitudes of vibrations may change in the manner described above, e.g., automatically based on pre-programmed settings for device 10 or in response to user inputs(s). Typically, such contraction will last fifteen to twenty minutes after use, and decrease thereafter. To promote weight loss, it may therefore be best to use device 10 no greater than ten minutes before eating, or to user it immediately before eating (e.g., one minute or less before eating). Of course, different people have different physiologies, which may result in differing periods of effect, e.g., for some people the full effect (or close to it) may last thirty minutes for more, whereas for others it may begin to dissipate after ten minutes. Each user may determine what works for himself when using device 10.

During its intended operation (e.g., when pressed against a person's abdomen), device 10 does not impart vibrations directly to the person's back and, in particular, to the person's spinal area. Such direct vibrations can be harmful. The vibrations imparted through the person's abdomen dissipate considerably, if not totally, by the time they reach the person's spine. This is in contrast to "belt-type" vibration devices, in which a belt fits around the person's back, and in which vibration is imparted directly to the back and spinal area.

To summarize, in an implementation, the device described herein is comprised of an upper and lower shell and an on/off button (e.g., switch). The bottom shell has a protrusion that sits on top of the naval of the user. The upper shell has an opening that allows a spring-loaded shaft connected to a circular convex surface on top to move up and down and toggle an electric switch inside the device. The spring determines the amount of inward force needed to activate the switch. An off-center mass electric motor inside the cavity of the upper and lower shells is activated when enough force is applied to the on/off button.

The device allows a person to tighten surface and core abdominal muscles by vibrating these muscles while the person holds-in his stomach. This vibration, in combination with the inward force (e.g., towards, and orthogonal to, the abdomen) applied by the user, causes the already tightened abdominal muscles to further contract and to react to the active vibration. When this is repeated on a regular or semi-regular basis (e.g., prior to every meal), the abdominal muscles start to put pressure on the stomach and reduce the volume available for food ingestion. In turn, the user feels full after a smaller meal and thus may reduces his caloric intake on a consistent basis. The duration of each session may be around one to two minutes, and the user may further tighten abdominals by exhaling while pressing the device into the abdomen.

Upper shoulder muscles as well as upper trunk muscles both on the front and back of the user also may be toned using device 10 in the manner described herein. The spine is not directly subjected to vibration since there are no belts used. The amount of necessary force for each individual depends on their level of fitness and the spring is replaceable for application of lower or higher force. A dynamic force selector can be used instead of replacing various springs.

Any of the functionality described herein and its various modifications (hereinafter "the functions") is not limited to the hardware and software described herein. All or part of the functions shown herein using circuitry (e.g., switch 42, user interface 52, and controller 50) can be implemented, at least in part, using a computer program product, e.g., a computer program tangibly embodied in an information carrier, such as one or more non-transitory machine-readable storage media, for execution by, or to control the operation of, one or more data processing devices, a programmable processor, a computer, multiple computers, a smartphone, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions of the calibration process. All or part of the functions can be implemented as, special purpose logic circuitry, e.g., an FPGA (field programmable gate array) and/or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. Components of a computer include a processor for executing instructions and one or more memory devices for storing instructions and data.

Components of different embodiments described herein may be combined to form other embodiments not specifically set forth above. Components may be left out of the implementation shown in FIGS. 1 to 5 without adversely affecting its operation. Furthermore, various separate components may be combined into one or more individual components to perform the functions described herein.

An electrical connection may imply a direct physical connection or a connection that includes intervening components but that nevertheless allows electrical signals to flow between connected components. Any "connection"

involving electrical circuitry mentioned or shown herein, unless stated otherwise, is an electrical connection and not necessarily a direct physical connection regardless of whether the word "electrical" is used to modify "connection" and regardless of whether intervening components are shown as part of the connection.

The claims are not limited to the vibration device described herein. Other implementations not specifically described herein are also within the scope of the following claims.

What is claimed is:

1. A device comprising:

a base having a first surface and a second surface, the second surface configured to be pressed against a user;

a shaft movable relative to the base along an axis, the shaft extending outwardly from at least the first surface;

a motor configured to produce vibrations substantially along the axis, the vibrations being of sufficient magnitude to cause corresponding vibrations in the base;

an actuating mechanism to activate the motor;

a handle at an end portion of the shaft, the handle comprising a softer material than a material of the base, the softer material being configured to dampen the vibrations at the handle; and a sensor configured to sense electrical resistance information when the second surface is pressed against the user and further configured to send the electrical resistance information to a controller, wherein the electrical resistance information is indicative of a body fat measurement of the user, wherein the controller is configured to calibrate the vibrations based, at least in part, on the electrical resistance information, wherein configuration to calibrate the vibrations comprises configuration to set a value for one or more of a period, a frequency, and a magnitude of the vibrations in response to the electrical resistance information, wherein the motor configured to produce vibrations is capable of being activated by the actuating mechanism when the second surface is pressed against the user;

wherein the motor comprises a switching mechanism; and wherein the actuating mechanism comprises:

a spring inside of the shaft and configured to compress along the axis in response to force directed substantially along the axis towards the base, the switching mechanism being proximate to the spring so that an element contacts the switching mechanism when the spring is compressed by the force to thereby activate the motor.

2. The device of claim 1, wherein the motor comprises an off-center mass electric motor.

3. The device of claim 1, wherein the actuating mechanism comprises a dynamic force selector, the dynamic force selector being configurable to apply a force to a switch that activates the motor.

4. The device of claim 1, wherein the shaft intersects the base; and wherein the device further comprises a nub that is shorter than the shaft.

5. The device of claim 1, wherein the controller comprises a programmable processing device; and further comprising a user interface to provide an input that corresponds to the vibration.

6. The device of claim 1, wherein the second surface has a curvature that extends away from a part of the shaft that extends outwardly from the first surface.

7. The device of claim 1, further comprising a heating element on the second surface.

8. The device of claim 1, wherein the controller is configured to determine whether a muscle of the user is contracted based on the electrical resistance information received from the sensor and calibrate the vibrations based on the determination.

9. The device of claim 1, wherein the spring comprises a coil and wherein the coil is configured to compress along the axis.

10. A device comprising:

a base having a first surface and a second surface, the second surface configured to be pressed against a user;

a shaft movable relative to the base along an axis, the shaft extending outwardly from at least the first surface;

a vibrating device to produce vibrations substantially along the axis, the vibrations being of sufficient magnitude to cause corresponding vibrations in the base;

a controller for controlling the vibrating device;

a handle at an end portion of the shaft, the handle comprising a softer material than a material of the base, the softer material being configured to dampen the vibrations at the handle; and a sensor configured to sense electrical resistance information when the second surface is pressed against the user and further configured to send the electrical resistance information to the controller, wherein the electrical resistance information is indicative of a body fat measurement of the user, wherein the controller is configured to calibrate the vibrations based, at least in part, on the electrical resistance information, wherein configuration to calibrate the vibrations comprises configuration to set a value for one or more of a period, a frequency, and a magnitude of the vibrations in response to the electrical resistance information, wherein the motor configured to produce vibrations is capable of being activated by the actuating mechanism when the second surface is pressed against the user;

a switching mechanism; and an actuating mechanism, the actuating mechanism comprising:

a spring inside of the shaft and configured to compress in response to force directed substantially along the axis towards the base, the switching mechanism being proximate to the spring so that an element contacts the switching mechanism when the spring is compressed to thereby activate the vibrating device.

11. The device of claim 10, wherein the vibrating device comprises an off-center mass electric motor.

12. The device of claim 10, further comprising an actuating mechanism, the actuating mechanism comprising a dynamic force selector, the dynamic force selector being configurable to apply a force to a switch that activates the vibrating device.

13. The device of claim 10, wherein the shaft intersects the base; and wherein the device further comprises a nub that is shorter than the shaft.

14. The device of claim 10, wherein the controller comprises a programmable processing device; and further comprising a user interface to provide an input that corresponds to the vibration.

15. The device of claim 10, wherein the second surface has a curvature that extends away from a part of the shaft that extends outwardly from the first surface.

16. The device of claim 10, further comprising a heating element on the second surface.

* * * * *